United States Patent [19]

Lipowski et al.

[11] Patent Number: 4,634,451

[45] Date of Patent: Jan. 6, 1987

[54] AQUEOUS CARBONACEOUS MIXTURES

[75] Inventors: Stanley A. Lipowski, Livingston; José L. Villa, Bridgewater; John J. Miskel, Jr., Mendham; Reuben H. Grinstein, Denville, all of N.J.

[73] Assignee: Diamond Shamrock Chemicals Company, Dallas, Tex.

[21] Appl. No.: 732,745

[22] Filed: May 10, 1985

[51] Int. Cl.[4] ..... C10L 1/32

[52] U.S. Cl. ..... 44/51; 406/197; 252/353

[58] Field of Search ..... 44/51; 406/197; 252/353

[56] References Cited

U.S. PATENT DOCUMENTS

| | | | |
|---|---|---|---|
| 4,217,109 | 8/1980 | Siwersson et al. | 44/51 |
| 4,282,006 | 8/1981 | Funk | 44/51 |
| 4,330,301 | 5/1982 | Yamamura et al. | 44/51 |
| 4,514,189 | 4/1985 | Papalos et al. | 44/51 |
| 4,557,763 | 12/1985 | George et al. | 106/90 |

FOREIGN PATENT DOCUMENTS 0078938 5/1983 Fed. Rep. of Germany .

*Primary Examiner*—Mrs. Y. Harris-Smith
*Attorney, Agent, or Firm*—Leslie G. Nunn, Jr.

[57] ABSTRACT

Aqueous carbonaceous mixtures such as water slurries of solid particulate carbonaceous materials having reduced viscosity, a stabilized network of carbonaceous materials in water and improved pumpability are obtained by using a condensation product of an aldehyde in aldehyde liberating composition, ketone and sulfur dioxide in a sulfur dioxide liberating composition as dispersant, the dispersant being present in an amount sufficient to reduce viscosity of the slurry, stabilize the network of carbonaceous materials in water and improve pumpability. An improved process for the condensation product is disclosed.

29 Claims, No Drawings

AQUEOUS CARBONACEOUS MIXTURES

BACKGROUND OF THE INVENTION

1. Field of the Invention

This invention relates to aqueous carbonaceous mixtures for transport by pipeline and more particularly to aqueous coal slurries stabilized with a condensation product of an aldehyde liberating composition, ketone and a sulfur dioxide liberating composition.

2. Description of the Prior Art

Transportation is one of the major problems involved in use of particulate carbonaceous materials such as coal. One transportation method uses aqueous mixtures such as water slurries. However, aqueous slurries of finely ground coal containing over 55 weight percent solids are difficult to move with slurry pumps. This is because as the solids level is increased above 50 weight percent, water and solids tend to separate causing coal particles to build up in various areas in the pumping system. Dewatering of the slurry causes blockage and jamming in the pumping system.

On the other hand, decreasing weight percent of water in aqueous coal slurries is desirable because water is a major contributor to the cost of transport and processing operations. The less water transported the greater the volume of coal that can be moved, resulting in transport efficiencies. Further, water resources are limited. Also, during burning of coal, a significant amount of heat is required to vaporize the water. As the weight percent of water decreases, efficiency of the coal burning process increases. Hence, use of higher weight percent solids aqueous carbonaceous slurries than was heretofore feasible would be of great importance.

It is known that anionic surfactants with sulfonate groups are dispersants for coal water slurries. Examples taken from the literature appear below.

U.S. Pat. No. 4,282,006 —Funk, Aug. 4, 1981, describes a pipeline pumpable coal water slurry having a high content of coal particles with a minimum of void spaces and a maximum of particle surface area to enhance dispersing effects generated by electrolytes and/or dispersing agents added to the slurry. For anionic dispersing agents, see column 29, line 53 to column 31, line 9.

U.S. Pat. No. 4,330,301 —Yamamura et al, May 18, 1982, describes anionic dispersants for aqueous coal slurries which are sulfonation products of polycyclic aromatic compounds, salts thereof and formaldehyde condensates thereof.

European Patent Application No. 0 078 938 —SKW Trostberg Aktiengesellschaft, publication date May 18, 1983, describes thermostable acid group containing condensation products of aldehydes and ketones which can be used in water systems as thickening agents, retention agents, surface active agents, dispersing or liquifying agents. Use of these condensation products in clay water suspensions and oil water coal suspensions is suggested.

SUMMARY OF THE INVENTION

Aqueous carbonaceous mixtures such as water slurries of solid particulate carbonaceous materials having reduced viscosity, a stabilized network of carbonaceous materials in water and improved pumpability are obtained by using a condensation product of an aldehyde liberating composition, ketone and a sulfur dioxide liberating composition as dispersant, the dispersant being present in an amount sufficient to reduce viscosity of the slurry, stabilize the network of carbonaceous materials in water and improve pumpability.

DETAILED DESCRIPTION

At least one condensation product of an aldehyde liberating composition, ketone and a sulfur dioxide liberating composition is present in a water carbonaceous materials slurry in amounts sufficient to reduce viscosity of the slurry, stabilize the network of carbonaceous material in water and improve pumpability of the slurry. The term dispersant as used herein encompasses the above condensation product and mixtures thereof. For example, from about 0.01% by weight to about 0.5% by weight of dispersant based on the weight of carbonaceous materials and water in the slurry can be used. The slurries will have from about 50% to about 80% or higher solids with water being the balance to which the dispersant is added, usually as a solution or dispersion. Coal water slurries are also known as coal water mixtures (CWM).

The term "carbonaceous materials", as used herein, encompasses solid particulate carbonaceous fossil fuel materials which may have been powdered or pulverized to a size where at least 80% will pass through a 200 mesh screen (U.S. Series). Useful carbonaceous materials include bituminous and anthracite coals, coke, petroleum coke, lignite, charcoal, peat, admixtures thereof and the like.

Water used in carbonaceous materials slurries may be taken from any available source such as mine, well, river, lake water or desalinated ocean water having a sufficiently low mineral salt content such that the electrochemistry of the bound water layer and carrier water interface can be controlled so that corrosion of milling facilities, pipelines and furnaces will be minimized or inhibited.

Useful dispersants include those condensation products obtained by condensing an aldehyde liberating composition, a ketone and a sulfur dioxide liberating composition described in European Patent Application No. 0 078 938 —SKW Trostberg Aktiengesellschaft, publication date May 18, 1983 as well as those described herein.

The active ingredient in the aldehyde liberating composition may be any solution, compound, polymer which is capable of liberating any R-CHO where the radical R of the aldehyde R-CHO may be hydrogen, an aromatic or nonaromatic (cyclic or acryclic) carbo- or heterocyclic radical or araliphatic radical where the number of carbon atoms or carbon and hetero atoms is from about 1 to about 10. Aromatic radicals may be for example alpha or beta naphthyl, phenyl or furfuryl, araliphatic radicals such as benzyl or phenylethyl, nonaromatic cycloalkyl- and especially alkyl radicals preferentially with 1 to 6 carbon atoms such as methyl, ethyl, propyl and butyl. The aliphatic radicals may be branched or unsaturated such as vinyl compounds.

These aldehydes may also be substituted by one or more groups which do not impair the condensation reaction as for example by amino-, hydroxy-, alkoxy- or alkoxycarbonyl groups. Aldehydes having more than one aldehyde group as di- or trialdehydes which owing to their higher reactivity may be used where they are suitable. Lower saturated aldehydes such as formaldehyde or acetaldehyde and their polymeric forms (paraformaldehyde or paraldehyde) may be used.

Examples of saturated aliphatic aldehydes include formaldehyde or paraformaldehyde, acetaldehyde or paraldehyde, butyraldehyde, substituted saturated aliphatic aldehydes such as 3-methoxy-propionaldehyde and acetaldol, unsaturated aliphatic aldehydes such as acrolein, crotonaldehyde, furfural, 4-methoxy-furfural, propargylaldehyde, dialdehydes such as glyoxal and glutaraldehyde. Formaldehyde is a preferred aldehyde.

The formaldehyde liberating composition may be an aqueous solution containing from 10 to 40% formaldehyde, an alcohol solution of methanol, ethanol, propanol or the like containing from 30 to 55% formaldehyde, a polymeric form such as paraformaldehyde, trioxane or the like. Any composition such as acetals or the like which are capable of producing formaldehyde may be used.

Useful ketones include symmetrical or unsymmetrical ketones with acrylic aliphatic, araliphatic and/or aromatic hydrocarbon radicals whereby also at least one radical is nonaromatic. The hydrocarbon radicals may contain from about 1 to about 10 carbon atoms.

Acrylic aliphatic ketone radicals may be linear or branched, unsaturated or saturated alkyl radicals such as methyl, ethyl, propyl, butyl, nonyl, araliphatic radicals such as benzyl or phenylethyl and aromatic such as alpha or beta naphthyl and especially phenyl.

The ketones may be substituted by one or more substituent which does not impair the condensation reaction as for example by amino-, hydroxy-, alkoxy- or alkoxycarbonyl groups and/or by the acid groups present in the condensation product.

Examples of saturated acyclic ketones include acetone, methyl-ethyl ketone, methyl-iso-butyl ketone; for substituted saturated acrylic ketones methoxy acetone, diacetone alcohol, acetoacetic acid ester; for unsaturated aliphatic ketones methyl-vinyl ketone; mesityl oxide, phorone; for araliphatic ketones acetophenone, 4-methoxy-acetophenone, 4-acetyl-benzenesulfonic acid; for diketones diacetyl, acetylacetone, benzoylacetone.

The aldehyde and ketone may be used in their original form or as compounds with the sulfur dioxide liberating composition, for example as aldehyde-sulfite adducts or their salts. Two or more different aldehydes or ketones may be used.

Total number of carbon atoms or carbon atoms and hetero atoms in the aldehydes and ketones is chosen in such a way that the hydrophilic character of the condensation product is preserved. This depends also on the number of the sulfonyl groups in the condensation product and the ketone/aldehyde ratio. The preferred total number of aldehyde is 1 to 11, for ketones 3 to 12.

The active ingredient in the sulfur dioxide liberating composition may be sulfur dioxide, sulfurous acid ($H_2SO_3$), a water soluble salt of a sulfite, bisulfite, condensed sulfite such as a pyrosulfite or the like which is capable of liberating sulfur dioxide to form an adduct with an aldehyde. Useful salts include alkali metal salts such as sodium, lithium or potassium salts, ammonium salts, substituted ammonium salts such as monomethyl amine, diethyl amine or tripropyl amine salts or the like and the corresponding bisulfites.

The preferred mole ratio of ketone/aldehyde liberating composition/sulfur dioxide liberating composition is between 1/1 to 6 and 1/0.02 to 2.5. Molar ratios outside these ranges may be required in special situations.

Condensation products useful as dispersants are obtained by reacting the desired ketone, aldehyde liberating composition and sulfur dioxide liberating composition under alkaline conditions. Condensation products may be prepared using the following variations in the process:

(1) Charge the ketone and sulfur dioxide liberating composition first and add the aldehyde liberating composition, (2) Charge the aldehyde liberating composition and sulfur dioxide liberating composition first and add the ketone, (3) Charge the ketone and add a mixture of aldehyde liberating composition and sulfur dioxide liberating composition or an adduct of the aldehyde liberating composition with the sulfur dioxide liberating composition, (4) Charge the aldehyde liberating composition and add a mixture of ketone and sulfur dioxide liberating composition, (5) Simultaneous charging of aldehyde liberating composition, ketone and sulfur dioxide liberating composition.

In the variations (1) to (5), ketone may be replaced by a ketone-aldehyde-condensate which contains the total or partial amount of the necessary ketone or aldehyde liberating composition.

Generally the process by variation (1) is preferred. Variation (1) is best suited for less reactive components.

The condensation reaction may be initiated by heating moderately. If the reaction becomes exothermic, cooling may be necesary. To obtain a uniform product using less reactive materials, additional heating may be required.

The condensation may be carried out at pH of 8 to 14, preferably 11 to 13. The pH may be adjusted by adding basic materials such as hydroxides of mono- or divalent cations or with sodium sulfite which hydrolyzes in water solutions to give alkaline conditions.

The condensation may be carried out in a homogeneous or heterogeneous phase. Water or water mixtures may be used as the reaction medium. The water content may be at least 50%. Polar organic solvents such as alcohols and acid esters may be added. The condensation may be carried out in open vessels or autoclaves. An inert atmosphere such as nitrogen may be used. The condensation products are obtained in the form of aqueous solutions or dispersions. Their solids content may be between about 10 and 70% by weight. If desired, they may be dried on a rotary drier or in a spray drier. Solutions or dispersions of the condensation products may also be used "as is".

An improved condensation product may be obtained by condensing (1) from about 2.1 to about 2.8 moles of formaldehyde or formaldehyde liberating composition with (2) one mole of an adduct of stoichiometrically equivalent amounts of formaldehyde or formaldehyde liberating composition and sulfur dioxide or sulfur dioxide liberating composition condensed with from about 1.2 to about 1.4 mole of acetone.

The improved product may be prepared using the following steps in seriatim:

(A) reacting in aqueous medium stoichiometrically equivalent amounts of formaldehyde in an aldehyde liberating composition and sulfur dioxide in a sulfur dioxide liberating composition to obtain an adduct thereof, (B) condensing 1 mole of the adduct with from about 1.2 to about 1.4 mole of acetone at elevated temperatures to obtain an intermediate, (C) condensing the intermediate with about 2.1 to about 2.8 moles of formaldehyde in an aldehyde liberating composition at elevated temperatures, and (D) reacting at elevated temperatures until a condensation product having a weight average molecular weight of from about 15,000 to about 25,000 is obtained.

A high performance heat stable dispersing agent is produced by this process. Products containing a reduced sodium formate content may be prepared. These products are useful as dispersants in coal water slurries.

Unexpected discovery of critical process parameters resulted in development of high performance heat stable dispersing agents containing reduced sodium formate content. These products may be produced using a formaldehyde aqueous solution as a formaldehyde liberating composition, acetone and sodium sulfite as a sulfur dioxide liberating composition in the following process:

(a) a sodium sulfite aqueous solution containing about 15–18% by weight sodium sulfite is prepared, (b) an equivalent amount of a formaldehyde aqueous solution containing 37% by weight formaldehyde is added, to form a formaldehyde—sulfite adduct, (c) a ketone such as acetone in a molar ratio of about 1.2–1.4 of ketone to 1.0 of the adduct is added at a temperature between 30°–40° C. over a period of 0.5–1 hour, while maintaining the reaction temperature at a maximum of 45° C., (d) after all the ketone is added, the mixture is heated to about 60° C. which is the reflux temperature for acetone. Reflux is continued for 0.5–1 hour. Color of the solution changes gradually from white to lemon—yellow to orange to red to dark red, (e) a formaldehyde aqueous solution containing 37% by weight formaldehyde in an amount corresponding to a molar ratio of 2.1–2.8 moles of formaldehyde to 1 mole of the formaldehyde-sulfite adduct is added to the reaction medium at such a rate to raise temperature of the mixture to reflux which is about 100° C. Reflux is continued for 1 hour, (f) the resulting solution is concentrated to about 45% by weight solids, and (g) the concentrated solution is refluxed at about 105°–106° C. for about 6–8 hours until viscosity of the 45% by weight solids solution at 25° C. is 1000–1200 cps.

During the process, the pH is maintained at all times on the high alkaline side (over 11.5 up to 13.5). The resulting product can be spray-dried as is or in other variation of the invention partially neutralized to pH 10–10.5 with desalted sulfonic acids and then spray-dried. The preferred sulfonic acid is a condensation product of naphthalene sulfonic acid with formaldehyde which has been limed and desalted. Products produced by this process show excellent performance when used as dispersants in slurries, coal-water suspensions and the like.

The aforementioned molecular weights are weight average molecular weights determined by gel permeation chromatography, using sodium polystyrene sulfonates of known molecular weights as standards.

BASIC CHEMISTRY

As simple as this condensation process may appear, its basic chemistry is complicated. The infrared spectra show characteristic absorption bands for keto groups, hydroxy groups, acid groups and double bonds. There are several stages in the reaction. These stages can be followed by the color changes which occur. The initial water white solution changes gradually from light yellow to lemon yellow to orange to dark orange to light red to dark red to red-brown.

It is assumed that the following reactions are taking place:

a. Adduct formation:

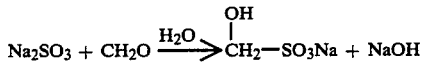

b. Acetone addition:

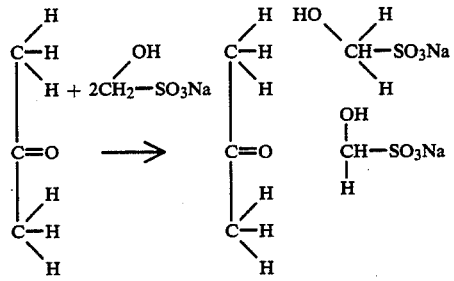

The initial reaction involves the keto-group and the methyl group in the acetone moiety. This is followed by water elimination and formation of double bonds.

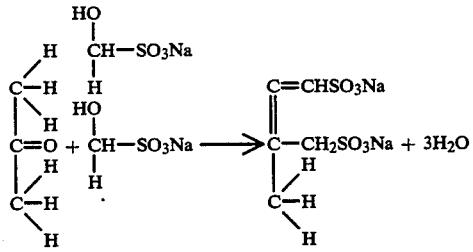

c. Next step involves the addition of formaldehyde and further elimination of water and formation of double bonds:

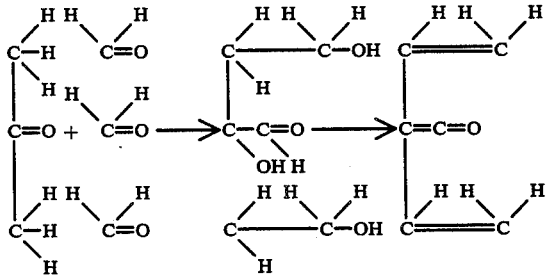

pH STUDY OF THE REACTION

1st stage—water solution of the formaldehyde-sulfite pH=13.2 adduct

2nd stage—acetone addition finished pH=13.8
3rd stage—reaction at 60° C. pH=13.5
4th stage—formaldehyde addition finished pH=11.9
5th stage—start of concentration pH=11.9
6th stage—end of concentration pH=11.9

For a fuller understanding of the nature and advantages of this invention, reference may be made to the following examples. These examples are given merely to illustrate the invention and are not to be construed in a limiting sence. All quantities, proportions and percentages are by weight and all references to temperature are ° C. unless otherwise indicated.

EXAMPLE I

This example demonstrates an improved preparation of a dispersant from acetone, formaldehyde and sodium sulfite.

A total of 90 parts by weight of sodium sulfite was dissolved in 400 parts by weight water to obtain a 18.36% by weight solution. To this solution were added 57 parts by weight of a 37% by weight formaldehyde water solution. The molar ratio of formaldehyde to sodium sulfite was 1.0 to 1.0. To the water solution of the resulting formaldehyde-sodium sulfite adduct were added slowly 58 parts by weight of acetone at such a rate that the temperature of the reaction did not exceed 45° C. The molar ratio of acetone to the formaldehyde-sodium sulfite adduct was 1.4 to 1.0. After all the acetone was added, the red colored solution was heated to 60° C. and maintained at 60° C. for 1 hour. Next, 162 parts by weight of formaldehyde 37% by weight water solution was added at such a rate as to raise the reaction mixture at the end of the addition to its reflux temperature which was 100° C. The molar ratio of formaldehyde to the formaldehyde-sodium sulfite adduct was 2.8 to 1.0 and the molar ratio of formaldehyde added to acetone was 2.0 to 1.0. The reaction mixture was refluxed for 1 hour. A sample of the cooled solution of reaction mixture had the following properties.

Solids 26.5% by weight,
Viscosity at 25° C., 6.5 cps, Brookfield, Spindle No. 1 at 60 RPM,
pH as is 13.2.

In the next step the solution was concentrated at atmospheric pressure to 45% by weight solids content. A sample of the concentrated solution had a viscosity of 200 cps and a pH as is of 11.9.

The concentrated solution was then refluxed for 6 hours. Viscosity of the solution gradually increased. After 6 hours at reflux, the viscosity was 1200 cps.

A sample of the concentrated solution of the condensation product was spray-dried to obtain a red-brown colored powder, containing 3% by weight moisture and 3% by weight sodium formate.

EXAMPLE II

This example demonstrates an improved preparation of a dispersant from acetone, formaldehyde and sodium sulfite.

The concentrated solution of the condensation product from the process according to Example I was partially neutralized to a pH of 10.0 by addition of a 42% active solution of the free acid of a limed and desalted naphthalene sulfonic acid formaldehyde condensate. This sample was designated as Example II. The naphthalene sulfonic acid formaldehyde condensate was prepared using the procedure in the first paragraph of Example I in U.S. Pat. No. 4,414,034 —Lipowski, issued Nov. 8, 1983.

EXAMPLE III

This example demonstrates preparation of a dispersant from acetone, formaldehyde and sodium sulfite according to Example A-1 in the SKW European Patent Application No. 0 078 938.

A total of 100 parts by weight of water, 63 parts by weight of sodium sulfite and 58 parts by weight of acetone were mixed together. The temperature rose to 32° C. Molar ratio of sodium sulfite to acetone was 0.5 to 1.0. The mixture was heated to 56° C. and 30 parts by weight of 30% by weight formaldehyde solution was slowly added at a constant rate. As soon as the reaction started, cooling was applied. The reaction took place with red coloring of the reaction mixture and high rate of acetone reflux. After the initial phase of the reaction subsided, 270 parts by weight of 30% by weight formaldehyde was added over 2 hours time while the temperature was maintained at 60°-70° C. with cooling. Molar ratio of formaldehyde added to sodium sulfite was 6.0 to 1.0 and molar ratio of formaldehyde to acetone was 3.0 to 1.0. After formaldehyde addition was complete, reaction temperature was raised to 90°-95° C. and maintained at this temperature for 1 hour.

A sample of the cooled solution of the condensation product contained 35% by weight solids and had a viscosity of 20 cps at 25° C. and an as is pH of 10.5.

A sample of the condensation product was spray-dried to obtain a red-brown colored powder, containing 3% by weight moisture and 15% by weight sodium formate.

EXAMPLE IV

This example is a variation of Example A-1 in the SKW European Patent Application No. 0 078 938.

The process of Example III was repeated with the only difference that instead of 300 parts by weight of formaldehyde 30% by weight, 400 parts by weight of formaldehyde 30% by weight were added. The molar ratio of sodium sulfite to acetone was 0.5 to 1.0. The molar ratio of formaldehyde to sodium sulfite was 8.0 to 1.0 and the molar ratio of formaldehyde to acetone was 4.0 to 1.0.

A sample of the spray-dried condensation product contained 3% by weight moisture and 18% by weight sodium formate.

EXAMPLE V

Molecular weight determinations of condensation products from Example I through IV were made using a Varian Model 5500 Liquid Chromatograph and Vista 402 Data Station with narrow molecular weight sodium polystyrene sulfonate standards. All determinations were made in triplicate.

| Sample of Example No. | Weight Average MW |
|---|---|
| I | 22,000 |
| II | 21,500 |
| III | 44,000 |
| IV | 43,000 |

EXAMPLE VI

This example demonstrates preparation of a dispersant using acetone, acetaldehyde and sodium sulfite according to Example A-7 in the SKW European Patent Application No. 0 078 938.

A charge of 5000 parts by weight of water, 1260 parts by weight of sodium sulfite and 1160 parts by weight of acetone was mixed together and heated to 56° C. To this charge was added 1760 parts by weight of acetaldehyde in the same manner as in Example A-1 and maintained for 4 hours at 90° to 95° C. The orange-brown condensation product contained 40% by weight solids and had a viscosity of 450 cps at 20° C.

EXAMPLE VII

This example demonstrates preparation of a dispersant using methylethylketone, formaldehyde and sodium sulfite according to Example A-11 in the SKW European Patent Application No. 0 078 938.

To a steel autoclave equipped with agitator, thermocouple and pressure gauge was charged 1500 parts by weight water, 1890 parts by weight sodium sulfite and 1440 parts by weight of methylethylketone. The autoclave was closed. A solution of 4000 parts by weight of 30% aqueous solution of formaldehyde preheated to 70° C. was introduced using a measuring pump. During addition of formaldehyde, the reaction temperature was held at a maximum of 85° C. and the reaction pressure at a maximum of 30 psi. After addition was complete, the reaction mixture heated in the closed autoclave at 90° to 100° C. for one hour, cooled to room temperature and discharged. The condensation product was an orange red, high foaming solution containing 48% by weight solids and having a viscosity of 1200 cps.

EXAMPLE VIII

The condensation products from Examples I through III were evaluated as dispersants in coal water slurries. The following procedure was used in evaluation of these condensation products in aqueous coal slurries (CWM). This procedure determines ability of these products to disperse or suspend coal dust uniformly in water by measuring viscosity and examining any sediment, if formed.

SCOPE Evaluation of dispersants in aqueous coal slurries and their efficacy to disperse or suspend coal dust uniformly in water.

PRINCIPLE Transport problems are one of the major difficulties in the use of coal. Aqueous slurries of finely ground coal containing more than about 55 weight percent solids are difficult to transport using conventional slurry pumps, because when the solids level is increased above 50 wt. %, water and solids tend to separate causing coal particles to build up in parts of the pumping system. It has been shown that addition of small amounts of dispersant and/or certain water soluble polymers to aqueous coal slurries permit the transport of coal slurries with much higher wt. % solids content than were heretofore possible.

APPARATUS 1. 8-Oz. paint can.
2. Low shear mechanical mixer with a double blade.
3. Spatula.
4. Stormer viscometer.

REAGENTS

1. Water (record hardness).
2. Coal dust—Reference coal is Pittston Coal, 80% thru 200 mesh. Other types of coal and grind sizes can be substituted.
3. Dispersants (condensates).

PROCEDURE

A 1000 gram sample of a 60/40 coal/water slurry was prepared by adding coal slowly to the water with agitation using a low shear mechanical mixer with a double blade. Sides of the container were scraped to insure uniformity of the slurry while mixing. After all the coal was added, the slurry was then stirred an additional 30 minutes.

1. 200 grams of 60/40 coal/water slurry was placed in an 8 oz. paint can and was set aside as the Blank (CWM without dispersant). This procedure was repeated with the exception that to each new sample was added pre-determined amounts of dispersant based on the weight of coal (concentration from 0.1 to 0.2, Table I).
2. All containers were closed tightly to prevent evaporation of the water.
3. Each container was opened and the slurry was stirred with a spatula before viscosity measurements were made with the Stormer viscometer. The weights were adjusted so that a reading was obtained for a 30 second viscosity. After obtaining the correct weight for a 30 second viscosity, the reading was repeated twice. The average of the two reading was then recorded as the viscosity of each CWM in seconds.
4. The procedure in Step 3 was repeated with slurries of each dispersant until the dispersant no longer reduced the viscosity of the slurry.
5. Time in seconds was converted into Krebs Units and Krebs Units to Centipoise (cps) readings.
6. Results of this procedure are shown in Table I.

The procedure was used to measure the viscosity (cps) and sediment of the following 60/40 Pittston/water slurries containing various dispersants shown in Table I.

TABLE I

| Dispersant of Example | Concentration % Dispersant | Initial Viscosity cps | Type 24 Hour Sediment[1] |
|---|---|---|---|
| I | 0.1 | 480 | (a) soft |
| | 0.2 | 300 | (c) semi-firm |
| II | 0.1 | 575 | (a) soft |
| | 0.2 | 360 | (b) semi-firm |
| III | 0.1 | 480 | (a) soft |
| | 0.2 | 390 | (d) firm |
| Blank | 0.0 | 4000 | (d) firm |

[1]The following types of sediments were noted:
(a) soft - very easy dispersible
(b) semi-firm - dispersible with vigorous agitation
(c) semi-firm - very difficult to disperse
(d) firm - very hard not dispersible under any conditions.

EXAMPLE IX

The condensation products from Examples I, II, III, VI and VII were evaluated as dispersants in coal water slurries using the procedure given in Example VIII to obtain the results shown in Table II.

TABLE II

| Dispersant of Example | Concentration % Dispersant | Initial Viscosity cps | Type 24 Hour Sediment | Type 72 Hour Sediment |
|---|---|---|---|---|
| I | 0.1 | 480 | soft | soft |
| | 0.3 | 250 | semi-firm (c) | semi-firm (c) |
| II | 0.1 | 575 | soft | soft |
| | 0.3 | 300 | semi-firm (c) | semi-firm (c) |
| III | 0.1 | 700 | soft | firm |
| | 0.3 | 460 | firm | firm |
| VI | 0.1 | 925 | soft | firm |
| | 0.3 | 460 | firm | firm |
| VII | 0.1 | 900 | soft | firm |
| | 0.3 | 550 | firm | firm |
| Blank | 0.0 | 4000 | firm | firm |

While the invention has been described with reference to certain specific embodiments thereof, it is understood that it is not to be so limited since alterations and changes may be made therein which are within the full intended scope of the appended claims.

What is claimed is:

1. A water slurry of solid particulate carbonaceous materials having present a water soluble dispersant which is a condensation product of (a) an aldehyde liberating composition, (b) ketone, and (c) a sulfur dioxide liberating composition, the dispersant being present in an amount sufficient to reduce viscosity of the water slurry, to stabilize carbonaceous materials in the water network and to improve pumpability of the water slurry, the slurry having from about 50% to about 80% by weight of the solid carbonaceous materials, the balance being water.

2. The water slurry of claim 1 wherein the aldehyde in the aldehyde liberating composition has from about 1 to about 10 carbon atoms and the ketone has from about 3 to about 21 carbon atoms.

3. The water slurry of claim 1 wherein the aldehyde in the aldehyde liberating composition is formaldehyde and the ketone is acetone.

4. The water slurry of claim 1 wherein the sulfur dioxide liberating composition is sodium sulfite.

5. The water slurry of claim 1 wherein the dispersant is a condensation product of (1) from about 2.1 to about 2.8 moles of formaldehyde in the aldehyde liberating composition with (2) one mole of an adduct of stoichiometrically equivalent amounts of formaldehyde in the aldehyde liberating composition and sulfur dioxide in the sulfur dioxide liberating composition condensed with from about 1.2 to about 1.4 mole of acetone.

6. The water slurry of claim 5 wherein the dispersant is an alkaline condensation product.

7. The water slurry of claim 1 wherein the active ingredient in the sulfur dioxide liberating composition is selected from the group consisting of sulfurous acid, a water soluble salt of a sulfite, a water soluble salt of a bisulfite and a water soluble salt of a condensed sulfite.

8. The water slurry of claim 7 wherein the active ingredient in the sulfur dioxide liberating composition is sodium sulfite.

9. The condensation product of claim 1 wherein the active ingredient in the aldehyde liberating composition is selected from the group consisting of an aqueous solution of formaldehyde, an alcohol solution of formaldehyde and a formaldehyde polymer.

10. The condensation product of claim 5 wherein the active ingredient in the formaldehyde liberating composition is an aqueous solution of formaldehyde.

11. The condensation product of claim 5 wherein the product is a partially neutralized condensation product.

12. The condensation product of claim 5 wherein the product is a partially neutralized condensation product containing naphthalene sulfonic acid formaldehyde condensate.

13. The condensation product of claim 5 having reduced sodium formate content.

14. The condensation product of claim 5 produced by a process comprising in seriatim the steps of:

(A) reacting in aqueous medium stoichiometrically equivalent amounts of formaldehyde in the aldehyde liberating composition and sulfur dioxide in the sulfur dioxide liberating composition to obtain an adduct thereof, (B) condensing 1 mole of the adduct with from about 1.2 to about 1.4 mole of acetone at elevated temperatures to obtain an intermediate, (C) condensing the intermediate with about 2.1 to about 2.8 moles of formaldehyde in the aldehyde liberating composition at elevated temperatures, and (D) reacting at elevated temperatures until a condensation product having a weight average molecular weight of from about 15,000 to about 25,000 is obtained.

15. The condensation product of claim 14 wherein process steps (A) through (D) are carried out at a pH above 11.5.

16. The condensation product of claim 14 wherein the active ingredient in the aldehyde liberating composition used in the process is an aqueous solution of formaldehyde.

17. The condensation product of claim 14 wherein the active ingredient in the sulfur dioxide liberating composition used in the process is sodium sulfite.

18. The condensation product of claim 14 wherein the temperature in process step (B) is from about 30° to about 60° C.

19. The condensation product of claim 14 wherein the condensation product in process step (D) is partially neutralized with a mineral acid.

20. The condensation product of claim 14 wherein the condensation product in process step (D) is partially neutralized with a naphthalene sulfonic acid formaldehyde condensate.

21. A process for producing a condensation product of an aldehyde liberating composition, a sulfur dioxide liberating composition and a ketone comprising in seriatim the steps of:

(A) reacting in aqueous medium stoichiometrically equivalent amounts of an aldehyde in an aldehyde liberating composition and a sulfur dioxide in a sulfur dioxide liberating composition to obtain an adduct thereof, (B) condensing 1 mole of the adduct with from about 1.2 to about 1.4 mole of a ketone at elevated temperatures to obtain an intermediate, (C) condensing the intermediate with about 2.1 to about 2.8 moles of an aldehyde in an aldehyde liberating composition at elevated temperatures, and (D) reacting at elevated temperatures until a condensation product is obtained.

22. The process for producing a water soluble condensation product of claim 21 comprising in seriatim the steps of:

(A) reacting in aqueous medium stoichiometrically equivalent amounts of formaldehyde in the aldehyde liberating composition and sulfur dioxide in the sulfur dioxide liberating composition to obtain an adduct thereof, (B) condensing 1 mole of the adduct with from about 1.2 to about 1.4 mole of acetone at elevated temperatures to obtain an intermediate, (C) condensing the intermediate with about 2.1 to about 2.8 moles of formaldehyde in the aldehyde liberating composition at elevated temperatures, (D) reacting at elevated temperatures for a period of from about 1 to about 3 hours, (E) condensing to a solids content of about 45 to about 46% by weight, and (F) reacting at elevated temperatures until a condensation product having a weight average molecular weight of from about 15,000 to about 25,000 is obtained.

23. The process of claim 21 wherein process steps (A) through (D) are carried out at a pH above 11.5.

24. The process of claim 21 wherein the aldehyde liberating composition is an aqueous solution of formaldehyde.

25. The process of claim 21 wherein the sulfur dioxide liberating composition is sodium sulfite.

26. The process of claim 21 wherein the temperature in process step (B) is from about 30° to about 60° C.

27. The process of claim 21 wherein the condensation product in process step (D) is partially neutralized with mineral acid.

28. The process of claim 21 wherein the condensation product in process step (D) is partially neutralized with a naphthalene sulfonic acid formaldehyde condensate.

29. The condensation product produced by the process of claim 21.

* * * * *